United States Patent [19]

Pebler et al.

[11] Patent Number: 4,485,094

[45] Date of Patent: Nov. 27, 1984

[54] METHOD OF MAKING $ABO_3$ OF THE CUBIC PEROVSKITE STRUCTURE

[75] Inventors: Alfred R. Pebler, Penn Hills; Robert G. Charles, Hampton Township, Allegheny County, both of Pa.

[73] Assignee: Westinghouse Electric Corp., Pittsburgh, Pa.

[21] Appl. No.: 461,800

[22] Filed: Jan. 28, 1983

[51] Int. Cl.[3] ..... B05D 3/02; B05D 5/12; H01M 6/30

[52] U.S. Cl. ..... 427/87; 204/290 R; 427/126.2; 427/126.3; 427/226; 427/376.2; 429/111

[58] Field of Search ..... 427/87, 126.2, 126.3, 427/226, 376.2; 429/111; 204/290 R

[56] References Cited

U.S. PATENT DOCUMENTS

| | | | |
|---|---|---|---|
| 3,081,200 | 3/1963 | Tompkins | 427/126.3 |
| 3,850,665 | 11/1974 | Plumat et al. | 427/226 X |
| 4,070,504 | 1/1970 | Bianchi et al. | 427/126.3 |
| 4,215,155 | 7/1980 | McKinzie et al. | 427/376.4 X |
| 4,361,603 | 11/1982 | Kubasov et al. | 427/126.3 X |
| 4,396,485 | 8/1983 | Gordon et al. | 204/290 R |

FOREIGN PATENT DOCUMENTS

| | | | |
|---|---|---|---|
| 5080482 | 6/1980 | Japan | 427/126.3 |

OTHER PUBLICATIONS

Wrighton, Mark S. et al., *Photoassisted Electrolysis of Water by Ultraviolet Irradiation of an Antimony Doped Stannic Oxide Electrode,* JACS;98:1, pp. 44–48, 1/7/76.

Mavroides, J. D. et al., *Photoelectrolysis of Water in Cells with $SrTiO_3$ Anodes,* Applied Physics Letters, vol. 28; 241 (1976).

Watanabe, Tadashi et al., i Photoelectrochemical Reactions at $SrTiO_3$ *Single Crystal Electrode,* Bulletin of the Chemical Society of Japan, vol. 49 (2), pp. 355–358, (1976).

Yoldas, B. E. et al., *Antireflective Coatings Applied from Metal–Organic Derived Liquid Precursors,* Applied Optics 18; 3133 (1979).

Sakka, Sumio et al., *Glasses From Metal Alcoholates,* Journal of Non-Crystalline Solids 42 (1980), p. 403.

*Primary Examiner*—Michael R. Lusignan

*Attorney, Agent, or Firm*—R. D. Fuerle

[57] ABSTRACT

Disclosed is a method of making a continuous mixed oxide thin film. A composition is prepared of an alkoxide source of one of the metals in the mixed oxide, a chelate source of a second metal in the mixed oxide, sufficient alcohol to solubilize sources of all metals in said mixed oxide and about 1 to about 2 moles of water per mole of mixed oxide. The composition is applied to a substrate and the coating on the substrate is heated to at least about 500° C. to evaporate the solvent and produce the mixed oxide film on the substrate.

19 Claims, 1 Drawing Figure

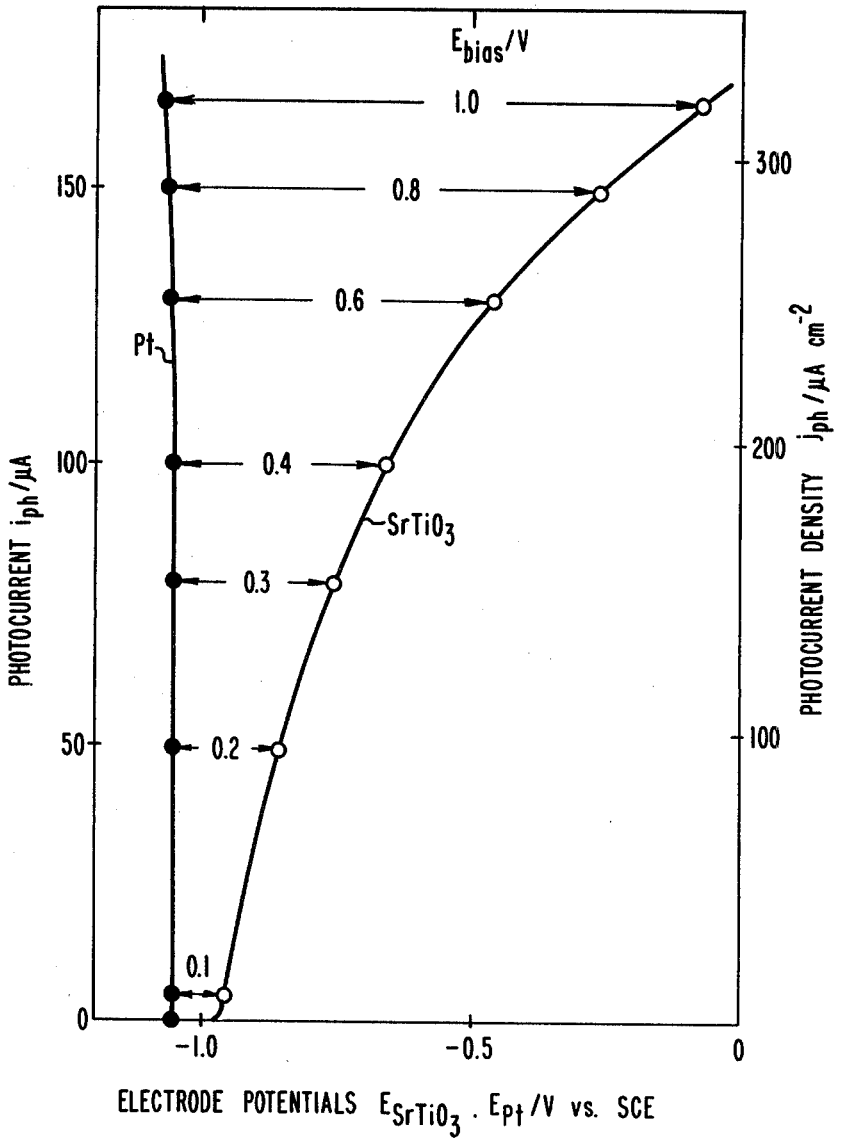
$E_{bias}$/V
1.0
0.8
0.6
0.4
0.3
0.2
0.1
Pt
$SrTiO_3$
150
100
50
0
300
200
100
PHOTOCURRENT $i_{ph}$/μA
PHOTOCURRENT DENSITY $j_{ph}$/μA $cm^{-2}$
−1.0
−0.5
0
ELECTRODE POTENTIALS $E_{SrTiO_3}$ . $E_{Pt}$/V vs. SCE

METHOD OF MAKING $ABO_3$ OF THE CUBIC PEROVSKITE STRUCTURE

BACKGROUND OF THE INVENTION

The possibility of efficiently decomposing water into hydrogen and oxygen has attracted a great deal of research as a way of storing energy in the form of a clean burning fuel. The discovery that n-type titanium dioxide and strontium titanate will catalyze the photoelectrolysis of water means that water can be decomposed by sunlight with the addition of little or no other energy. Strontium titanate is an especially good catalyst for this purpose because its quantum efficiency in the absence of a bias voltage is about an order of magnitude higher than that obtained with titanium dioxide.

A major drawback in the use of strontium titanate for this purpose, however, is its high cost of preparation. Until now, n-type strontium titanate photo-electrodes were prepared by cutting slices from a single crystal, then reducing the slices in a hydrogen atmosphere at about 900° C. Growing single crystal strontium titanate and preparing the n-type disk from the single crystals made the material too expensive for use in any commercial process.

SUMMARY OF THE INVENTION

We have discovered that continuous mixed oxide films can be made by reacting alkoxides with chelates in solution followed by evaporation of the solvent. The electrodes produced for solar cells by the process of this invention are much less expensive than those produced by prior processes because the process itself is less expensive and less material is required because the film is thin. The process of this invention occurs at low temperatures which is unusual for producing a ceramic material as ceramics normally are produced at temperatures of about 2000° C. Because the mixed oxides are produced from solutions, they are much more homogeneous than mixed oxides produced by other methods. While the product of this invention is polycrystalline instead of single crystal, it can be produced in a thin film of any configuration on a substrate of almost any shape. Mixed oxides which cannot be produced by other techniques may be producible by the process of this invention because the process of this invention uses compounds such as acetylacetonates which are formed with a great variety of different types of metals.

RELEVANT ART

An article by J. D. Mavroides et al. titled "Photoelectrolysis of Water in Cells with $SrTiO_3$ Anodes," in Applied Physics Letters, Vol. 28; 241 (1976) discloses the use of single crystal n-type $SrTiO_3$ anodes to photoelectrolyze water.

An article by B. E. Yoldas, et al. titled "Anti-reflective Coatings Applied From Metal-Organic Drive Liquid Precursors," in Applied Optics 18; 3133 (1979) discloses the preparation of $TiO_2$ and $TiO_2$-$SiO_2$ coatings from alkoxides.

An article by Sumio Sakka, et al. titled "Glasses From Metal Alcoholates," in the Journal of Non-Crystalline Solids 42 (1980) pg. 403, discloses the preparation of barium titanate and strontium titanate from alkoxides.

An article by Sadashi Watanahe et al. titled "Photoelectrochemical Reactions of $SrTiO_3$ Single Crystal Electrode," in the Bulletin of the Chemical Society of Japan, Vol. 49(2), pages 355 to 358 (1976) discloses the photoelectrolysis of water using single crystal strontium titanate.

DESCRIPTION OF THE INVENTION AND DRAWING

The accompanying drawing is a graph which shows the relationship between the electrode potential of strontium titanate and the photocurrent and the photocurrent density.

The continuous mixed oxide films which can be produced by the method of this invention have the general formula $MO_n$ where M is a mixture of at least two metals and n is the number of oxygen atoms in the compound. Of particular interest are the binary oxides which have a general formula $A_xB_yO_z$ where x times the valence of A plus y times the valence of B is equal to two times z. Of the $A_xB_yO_z$ compounds, those of the cubic perovskite structure having the general formula $ABO_3$, where A is bivalent and B is tetravalent, are of special commercial importance. The A metal, for example, could be barium, strontium, calcium, or mixtures thereof and the B metal, for example, could be titanium, zirconium, hafnium, or mixtures thereof. The A atom is always larger, and the ionic radii of A and B should preferably satisfy the relation $$R_A + R_O = \sqrt{2}\ (R_B + R_O)$$

where $R_A$, $R_B$, and $R_O$ are the radii of A, B, and the mixed oxide. Particularly preferred are strontium and titanium because strontium titanate is chemically stable and has a desirable band structure.

In order to form the mixed oxide it is necessary to have a source of each metal that is in the mixed oxide. In the method of this invention, at least one of the sources must be a metal alkoxide and at least one of the sources must be a metal chelate. Metal alkoxides have the formula $M(OR)_n$ where M is the metal, n is the valence of the metal and R is typically an alkyl group. The smaller alkyl groups (i.e., $C_1$ to $C_6$) are preferred as they give alkoxides which are more volatile and more soluble.

Examples of suitable chelates include the $\beta$- diketonates such as the metal acetylcetonates, which are the metal derivatives of $\beta$-diketones having the general formula

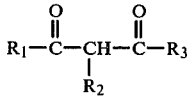

where $R_1$ and $R_3$ are independently selected from alkyl, substituted alkyl, aryl, and substituted aryl groupings, and $R_2$ is $R_1$ or —F, —Cl, —Br, —I, —NO, —$No_2$, etc.) Other suitable chelates include, 8-hydroxy-quinolates, 8-mercapto quinolates, or metal derivatives of ethylene diamine tetracetic acid, ortho hydroxy quinones, ortho hydroxy aldehydes, and ortho hydroxy ketones. The $\beta$-diketonates are the preferred chelates, and the metal acetylacetonates are the preferred $\beta$-diketonates because these compounds have been found to work well for the synthesis of mixed oxides and they can be formed with a large variety of different metals. The properties of the resulting film depend to a large extent on the particular compounds selected as sources of the metal oxides.

In the first step of this invention, a composition is prepared of an alkoxide source of one of the metals in the mixed metal oxide, a chelate source of a second metal in the metal oxide, sufficient solvent to solubilize the sources of all the metals in the mixed metal oxide, and about 1 to about 2 moles of water per mole of said mixed metal oxide. For example, ferrites can be produced from magnesium acetylacetonates and iron alkoxide, or from magnesium alkoxide and iron acetylacetonate. Garnets can be produced from mixtures of iron acetylacetonate and alkoxides of the rare earth metals or of yttrium.

The mixed oxides are oxides of two or more metals, one of which may be present in only a small quantity as a dopant. For example, lanthanum acetylacetonate can be added to a source of strontium as a dopant or niobium acetylacetonate can be added to a source of titanium as a dopant. If the dopant has a greater valence than the other metal, an n-type semiconductor is produced, and if the dopant has a lower valence than the other metal, a p-type semiconductor is produced.

The sources of the metals should be added in stoichiometric proportions, although it is also possible to produce non-stoichiometric compounds for certain mixed oxides. Solvents which can be used in dissolving the sources of the metals include dimethyl formamide, alcohol, tetrahydrofuran, and dimethyl sulfoxide. The preferred solvent in many instances has been found to be dimethyl formamide or solvent mixtures which contain dimethylformamide as one of the components. It is preferably to use as little solvent as is necessary to dissolve the two sources in order to avoid the later unnecessary evaporation of solvent.

In the second step of the process of this invention, the composition is applied to a substrate. Substrates may be metals, glasses, other ceramics, or semiconductors such as silicon or germanium. The preferred substrate is titanium metal if the mixed oxide is strontium titanate as that substrate is useful in making photoelectrodes or oxygen electrodes. If there are any flaws in the coating, the titanium will oxidize and self heal. Silicon substrates can be used for forming solar cells, glass substrates can be used for forming transparent structures, and porous ceramic substrates can be used for forming solid electrolytes for fuel cells and oxygen concentration cells.

According to the method of this invention the solvent is evaporated and the coating on the substrate is heated to at least 500° C. and preferably to at least 600° C. to crystallize the mixed oxide. It is preferable to heat the coating in air at about 400° to about 600° C. to oxidize the compounds in the composition to the mixed oxide and to evaporate the solvent and organics which are present. If desired, the coating may be made semiconducting by heating in a reducing atmosphere such as hydrogen at about 500° to about 600° C. for about a half hour.

The following examples further illustrate this invention.

EXAMPLE I

This example illustrates the formation of a continuous film of strontium titanate of the cubic perovskite structure. Strontium acetylacetonate sold by Alfa-Ventron (570 mg, $2\times10^{-3}$ moles, calculated as the anhydrous material) was weighed into a glass serum bottle. A magnetic stirring bar was added, and the bottle was capped with a laminated Teflon-rubber septum. Anhydrous dimethylformamide (30 ml) was added by a syringe through the septum. The mixture was stirred magnetically and heated gently on a water bath until all the solid was dissolved.

Titanium ethoxide, $Ti(OC_2H_5)_4$ from Alfa-Ventron, was transferred in a nitrogen filled glove box to a serum bottle equipped with a Teflon-rubber septum. Subsequent operations with this material could then be carried out in the open air by withdrawing quantities, as needed, through the septum with a graduated syringe. The serum bottle was stored in a desiccator over anhydrous calcium sulfate to guard against possible leakage of atmospheric moisture.

Four tenths of a milliliter of $TI(OC_2H_5)_4$ was transferred by syringe to the cooled strontium acetylacetonate solution, while stirring. This was followed by the addition of 1 ml of a 1:10 water-dimethylformamide solution. The resulting colorless mixture was reheated briefly, wile stirring, on a hot water bath. The mixture gradually became yellow with only a very little undissolved solid. After standing overnight at room temperature the solution was filtered through a fine porosity, sintered glass filter to give a clear yellow solution which precipitated no additional solid on extended standing. The amount of solid remaining on the filter was negligible. Uniform liquid films of the solution were applied to titanium substrates using a spinning technique. Surface polished disks (3/4 in. dia., 1/16 in. thick) were fastened to the shaft of an inverted, speed controllable electric stirring motor. Several drops of the solution were dispersed onto the substrate and the motor was brought up to a rotational speed of ~1000 rpm, leaving a firmly adherent film that began immediately to dry. Drying was accelerated with a heat gun. The coated disk was then transferred into a tubular furnace and heated to as high as 600° C. in flowing air. The heating in air was continued for about 25 min. followed by 15–45 min. heating in hydrogen. The sample was cooled down in an atmosphere of argon.

A single application left a visible coating on the Ti or Ni substrate. Judged by the interference colors the thickness of a single coating was on the order of 0.3–0.5 microns, which proved to be insufficient for X-ray analysis. However, polycrystalline strontium titanate with cubic perovskite structure was identified on a nickel substrate with five consecutive thin coats. Coatings that were heated to 400° C. were X-ray amorphous (glass-like) and had an extremely smooth surface. Heating to 500° C. and above caused increasing crystallization and surface roughening. Film failures appear to be caused by foreign particles and/or surface irregularities on the metal substrate. The fabrication of flawless films may require carefully controlled surface preparation of the substrates as well as clean room conditions.

The strontium titanate samples were illuminated by a xenon discharge lamp in a photoelectrochemical cell. The electrolyte, a 1 mole KOH solution, was circulated through the cell to maintain constant temperature, to facilitate stirring and to remove the reaction products. The irradiance was 100 $mW/cm^2$. The drawings shows the photocurrent as a function of the individual strontium titanate and platinum potentials, measured against a standard calomel electrode (SCE) at various applied bias voltages. A minimum bias potential of about 0.1 volts was required for this sample to commence photoelectrolysis. This falls somewhat short of the performance of a single crystal strontium titanate photoelectrode which showed photoelectrolysis already as zero bias. However further investigations are expected to optimize the fabrication and to improve the quality of the strontium titanate film, specifically in regards to thickness, crystal size, and flawlessness of the films. In the presence of oxygen the cathodic reaction will shift to the reduction of oxgyen in place of hydrogen ions. The illuminated photoelectrochemical cell then operates in a regenerative mode producing electrical power.

We claim:

1. A method of making a continuous film of mixed oxide of at least two metals comprising:

(A) preparing a solution which comprises:

(1) an alkoxide source of one of said metals;

(2) a chelate source of a second of said metals; and (3) sufficient solvent to solubilize the sources of said metals in said mixed oxide;

(B) adding to said solution about 1 to about 2 moles of water per mole of said mixed oxide;

(C) applying said solution to the surface of a substrate to form a coating on said substrate; and (D) heating said solution to at least about 500° C. to evaporate said solvent and produce said mixed oxide.

2. A method according to claim 1 wherein said mixed oxide has the general formula $A_xB_yO_z$ where A and B are metals and x times the valence of A plus y times the valence of B equals 2z.

3. A method according to claim 2 wherein said mixed oxide has the general formula $ABO_3$ where A is a bivalent metal and b is a tetravalent metal.

4. A method according to claim 3 wherein A is selected from the group consisting of barium, strontium, calcium, and mixtures thereof and B is selected from the group consisting of titanium, zirconium, hafnium, and mixtures thereof.

5. A method according to claim 4 wherein said mixed oxide is of cubic perovskite structure.

6. A method according to claim 5 wherein A is strontium and B is titanium.

7. A method according to claim 1 wherein said chelate is a metal β-diketonate.

8. A method according to claim 7 wherein said metal β-diketonate is a metal acetylacetonate.

9. A method of claim 1 wherein said solvent is dimethyl formamide.

10. A method according to claim 1 wherein said water is added to said solvent before said solvent is added to said sources.

11. A method according to claim 1 wherein said substrate is titanium.

12. A method according to claim 1 wherein said substrate is silicon.

13. A method according to claim 1 wherein said coating on said substrate is heated in hydrogen at 500° to 600° C. for ½ hour to dope said coating.

14. A method according to claim 1 wherein one of said metals is a dopant.

15. A method according to claim 1 wherein said solution includes about 0.01 to about 1 atomic percent of an n-type dopant.

16. A method according to claim 15 wherein said n-type dopant is selected from the group consisting of lanthanum, niobium, and mixtures thereof.

17. A method according to claim 1 including the additional last step of heating said solution in a reducing atmosphere.

18. A method according to claim 16 wherein said reducing atmosphere is hydrogen.

19. A method according to claim 1 wherein said substrate is glass.

* * * * *